US006158084A

United States Patent [19]

Weber et al.

[11] Patent Number: 6,158,084

[45] Date of Patent: Dec. 12, 2000

[54] VACUUM CLEANER AGITATOR CONTROL

[75] Inventors: Vincent L. Weber, North Lawrence; Jeffrey A. Morgan, Cuyahoga Falls; Kenneth L. Symensma, Canton; Glenn E. Specht, Massillon, all of Ohio

[73] Assignee: The Hoover Company, North Canton, Ohio

[21] Appl. No.: 09/468,507

[22] Filed: Dec. 21, 1999

Related U.S. Application Data

[63] Continuation of application No. 09/074,852, May 8, 1998.

[51] Int. Cl.[7] ..... A47L 9/04

[52] U.S. Cl. ..... 15/390; 15/332; 15/391

[58] Field of Search ..... 15/390, 391, 332, 15/333

[56] References Cited

U.S. PATENT DOCUMENTS

| | | | |
|---|---|---|---|
| 4,748,714 | 6/1988 | Tschudy | 15/390 |
| 4,766,640 | 8/1988 | Martin et al. | 15/390 |
| 5,031,267 | 7/1991 | Bewley | 15/389 |
| 5,537,712 | 7/1996 | Weber et al. | 15/391 |
| 5,768,746 | 6/1998 | Kamatani et al. | 15/390 |
| 5,839,160 | 11/1998 | Wang et al. | 15/390 |

*Primary Examiner*—Theresa T. Snider
*Attorney, Agent, or Firm*—A. Burgess Lowe

[57] ABSTRACT

A self-propelled vacuum cleaner is provided having an upper handle portion and a carriage pivotally mounted to a lower end of the handle portion for pivotal motion relative the handle portion about a horizontally extending carriage axis. A transmission drivingly connected to at least one drive wheel mounted on the carriage, whereby the at least one drive wheel propels the vacuum cleaner over a floor surface. A nozzle body pivotally mounted to the carriage for pivotal motion relative the carriage about a generally horizontally extending nozzle axis, the nozzle body having a downward facing suction opening. The nozzle axis being generally horizontally offset from the carriage axis.

23 Claims, 7 Drawing Sheets

VACUUM CLEANER AGITATOR CONTROL

This application is a continuation of co-pending U.S. patent application Ser. No. 09/074,852 filed on May 8, 1998.

BACKGROUND OF THE INVENTION

1. Field of the Invention

This application pertains to self-propelled upright vacuum cleaners. More specifically, this invention pertains to the manner in which the agitator chamber, which typically defines the floor nozzle, and the hard bag or handle portion of the vacuum cleaner are independently pivotally attached to the main frame of the vacuum cleaner with offset pivot axes.

This invention also pertains to an upright vacuum cleaner having a structure for automatically engaging and rotating the agitator when the bag housing is located in a generally inclined operating position and automatically disengaging and stopping rotation of the agitator when the bag housing is located in the upright storage position, which structure may also be manually actuated to maintain disengagement of the agitator for cleaning bare floors.

2. Description of Related Prior Art

Self-propelled upright vacuum cleaners conventionally include an electric motor that drives a fan for generating a vacuum, an agitator for agitating the carpet, and at least one drive wheel for propelling the cleaner over the floor. In order to propel the cleaner in both forward and reverse, self-propelled vacuum cleaner's typically contain a transmission having an input shaft that is drivingly connected to the motor's output shaft via a drive belt or by gears. The transmission is selectively controlled by the operator to convert the unidirectional input to the transmission into forward and reverse rotation at the transmission's output shaft. Drive is then transferred from the transmission's output shaft to the drive wheel(s).

In order to ensure that the vacuum cleaner is positively and smoothly driven in forward and reverse while traveling over an uneven floor surface, the drive wheels are frequently mounted to the main frame of the cleaner and the lower end of the handle portion of the vacuum cleaner is pivotally mounted to the main frame. With this arrangement, the main frame and the drive wheels can move up and down or "float" relative the handle portion of the cleaner as the cleaner travels over a floor surface and maintain substantially constant contact with the floor. In vacuum cleaners that have the drive wheel(s) mounted to the transmission's output shaft, the entire transmission must be mounted to the main frame in order to enable the drive wheel(s) to float.

In order to maintain the suction nozzle in substantially continuous contact with the floor surface being cleaned, the agitator chamber, which normally defines the floor nozzle, is also typically mounted to the main frame or to the handle portion in a floating fashion. Since the floor nozzle and the drive wheels contact the floor at different locations, the floor nozzle is preferably independently mounted to the main frame or to the handle portion so that the floor nozzle will float on the floor independently of the drive wheels. Thus, the transmission, or at least the drive wheel(s), and the agitator chamber move independently up and down relative the handle portion of the cleaner, so that both the drive wheel(s) and the floor nozzle maintain substantially constant engagement with the floor surface.

U.S. Pat. No. 4,171,554 discloses a prior art self-propelled upright vacuum cleaner that has an agitator chamber and a transmission that are independently mounted to the handle portion of the cleaner for independent up and down motion relative to the lower end of the handle portion. The disclosed transmission is mounted to a first metal frame that is pivotally mounted to the hard bag or handle portion of the upright vacuum cleaner on trunnions extending outward from either side of the lower end of the handle portion. The agitator chamber is likewise mounted to a second metal frame that is also pivotally mounted to the trunnions on the lower end of the handle portion of the vacuum cleaner. The vacuum cleaner's motor is housed in the lower end of the handle portion of the cleaner and the trunnions are located concentrically with the motor's output shaft. Locating the trunnions concentrically with the motor's output shaft enables the transmission and the agitator to pivot about the motor's output shaft. Since the agitator and the transmission pivot about the motor's output shaft, the distance between the motor's output shaft and the transmission and the distance between the motor's output shaft and the agitator remain constant as the agitator and the transmission move up and down relative to the lower end of the handle portion. Maintaining the distances between the motor and the transmission and between the motor and the agitator constant allows simple stretch belts to be employed between the motor and the transmission and between the motor and the agitator for transferring power from the motor to the transmission and from the motor to the agitator.

Manufacturing components out of metal has become undesirable. With modem materials and manufacturing techniques, manufacturing parts out of plastic has become more flexible, efficient and cost effective than manufacturing parts out of metal. Therefore, it is desirable to manufacture a self-propelled upright vacuum cleaner that has a transmission and an agitator chamber that are each independently pivotally mounted on plastic, as opposed to metal, frames. Plastic frames, however, must have thicker walls if they are to have the same strength and rigidity as a metal frame. Thus, if one were to simply manufacture the arrangement disclosed in the previously discussed U.S. Pat. No. 4,171,554 by replacing the metal frames with correspondingly strong and rigid plastic frames pivotally mounted on the trunnions on the handle portion, the necessarily thicker plastic frames would cause the cleaner to be undesirably wide and bulky.

SUMMARY OF THE INVENTION

It is an object of the present invention to provide a self-propelled upright vacuum cleaner in which all of the major components are manufactured from modem plastic or composite materials.

It is a further object of the present invention to provide a self-propelled upright vacuum cleaner that has all of its major components formed of modem plastics and that has independently floating drive wheel(s) and floor nozzle.

It is a further objective of the present invention to provide a self-propelled upright vacuum cleaner in which the drive wheel(s) and the floor nozzle independently move up and down while travelling over a floor surface, in order to ensure substantially constant drive and cleaning.

It is a yet a further objective of the present invention to provide an upright vacuum cleaner having dual belt drive system that performs as an overload clutch for preventing motor stall and burnout in the event the agitator is stalled.

These and other objectives are achieved by the present invention by providing an upright self-propelled vacuum cleaner having offset nozzle and drive wheel pivot points. In the preferred embodiment, the drive wheels are mounted to the transmission's output shaft and the transmission is mounted on a main frame or carriage. The carriage has sidewalls that are pivotally mounted to trunnions extending out from either side of the lower end of the handle portion concentric to the motor's output shaft. The agitator is mounted in a floor nozzle having integrally formed side members that are pivotally mounted to the sidewalls of the carriage at a location offset, preferably forward, from the trunnions on the handle portion. By pivotally mounting the floor nozzle to the carriage at a location spaced forward of the trunnions on the handle portion, only the main frame or carriage is mounted to the outer sides of the lower end of the handle portion of the cleaner. Therefore, only the width of the sidewalls of the carriage add to the overall width of the cleaner at the trunnions. As a result of this arrangement, the entire carriage and the entire floor nozzle may be made of economical modem plastic or composite materials without unduly adding to the overall width of the cleaner compared to a vacuum cleaner having a metal main frame and/or carriage having metal sidewalls attached to the floor nozzle.

The present invention further provides for a self-propelled upright vacuum cleaner comprising, an upper handle portion, a carriage pivotally mounted to a lower end of the handle portion for pivotal motion relative said handle portion about a generally horizontally extending carriage axis, a transmission, said transmission being drivingly connected to at least one drive wheel mounted on said carriage, whereby said at least one drive wheel at least partially supports said vacuum cleaner on a floor surface and propels the vacuum cleaner over a floor surface, a nozzle body pivotally mounted to said carriage for pivotal motion relative said carriage about a generally horizontally extending nozzle axis, said nozzle body having a downward facing suction opening. The present invention preferably provides such a self-propelled upright vacuum cleaner wherein said carriage axis is offset from said nozzle axis. More particularly the present invention preferably provides such a self-propelled upright vacuum cleaner wherein said nozzle axis is located generally forward of said carriage axis.

BRIEF DESCRIPTION OF THE DRAWINGS

A preferred embodiment of the present invention will now be described, by way of example, with reference to the accompanying drawings, of which:

FIG. 7 illustrates the cleaner with the handle portion in the inclined operating position and the agitator shut-off knob in the agitator-on position, and FIG. 8 illustrates the cleaner with the handle in the upright storage position and the agitator shut-off knob in the agitator-off position.

DETAILED DESCRIPTION OF THE INVENTION

Figure 1:
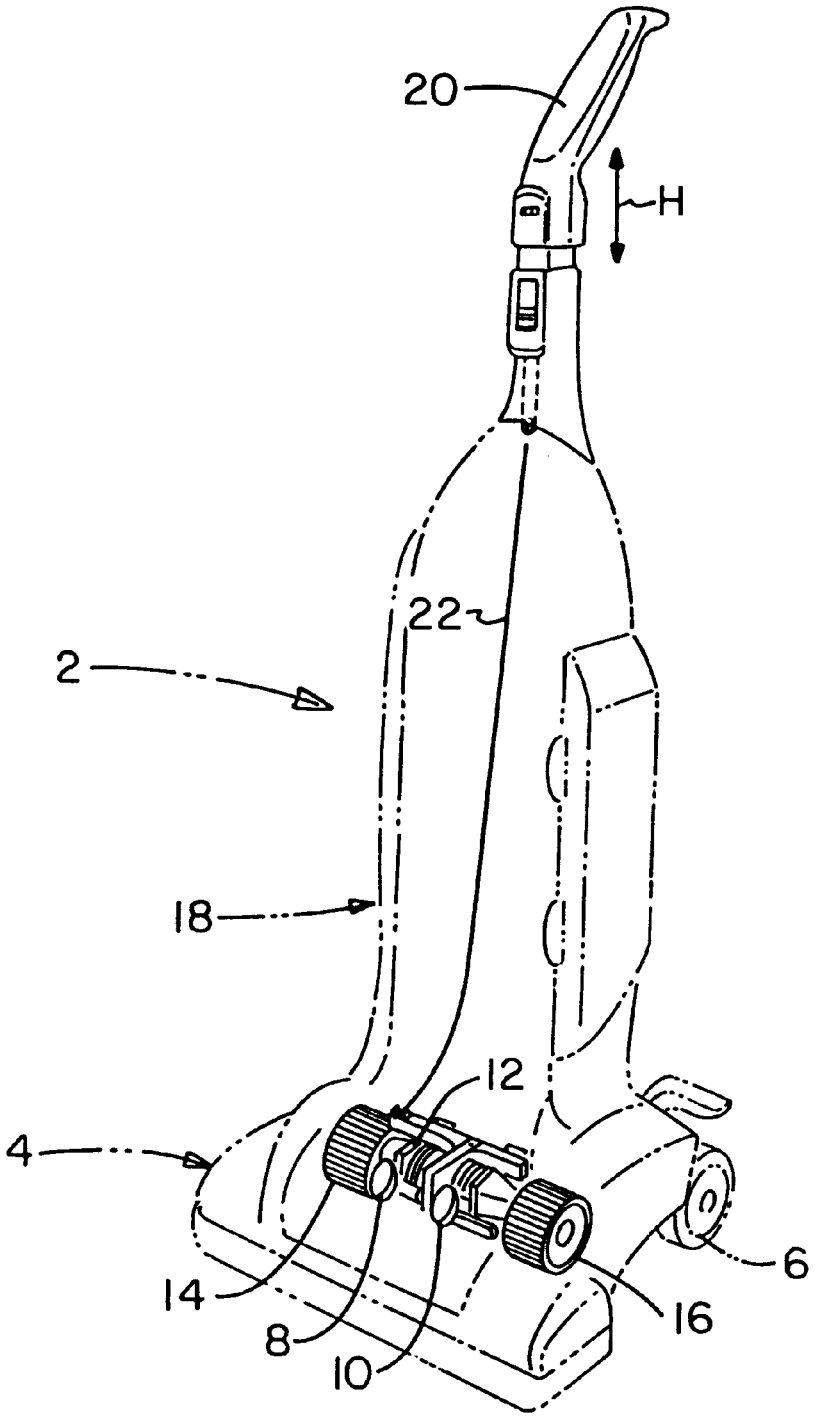
FIG. 1 is a diagrammatic perspective view of a self-propelled upright vacuum cleaner according to the present invention.

A self-propelled upright vacuum cleaner 2 according to a preferred embodiment of the present invention is diagrammatically illustrated by way of example in FIG. 1. The cleaner includes a foot or lower portion 4. The lower portion includes a floor nozzle, not visible in FIG. 1, located to the front of the lower portion 4. Freely rotating support wheels 6 (only one of which is visible in FIG. 1) are located to the rear of the lower portion. A manually actuated height adjustment knob 8 for adjusting the operating height of the floor nozzle relative to the floor and a manually actuated agitator shut-off knob 10 for turning the agitator off are located on the lower portion. The lower portion further includes a transmission 12 and drive wheels 14 and 16 for propelling the cleaner over a floor.

The details of the transmission 12 do not form a part of the present invention and are therefore not disclosed in detail herein. However, a suitable transmission for use with a self-propelled upright vacuum cleaner according to the present invention is disclosed in U.S. Pat. No. 3,581,591, the disclosure of which is hereby incorporated herein as of reference. Likewise, the details of the height adjustment mechanism do not form a part of the present invention and are therefore not described in detail herein. However, a suitable height adjustment mechanism for use with a self-propelled upright vacuum cleaner according to the present invention is disclosed in U.S. Pat. No. 4,171,554, the disclosure of which is hereby incorporated herein as of reference.

A bag housing or handle portion 18 is pivotally mounted to the lower portion 4 in a conventional manner for pivotal motion from a generally upright latched storage position, illustrated in FIG. 1, to an inclined pivotal operating position, not shown in FIG. 1. A hand grip 20 is slidably mounted to the upper end of the bag housing for limited reciprocal rectilinear motion relative the bag housing, as illustrated by arrow H in FIG. 1. The hand grip 20 is connected to the transmission 12, via a Bowden type control cable 22. As an operator pushes and pulls on the hand grip, the cable actuates the transmission to automatically drive the cleaner in forward and reverse in response to the forces applied to the hand grip by the operator. The details of the reciprocating hand grip 20 do not form a part of the present invention and are therefore not described in detail herein. Suitable hand grips for use with a self-propelled upright vacuum cleaner according to the present invention are disclosed in U.S. Pat. Nos. 3,618,687 and 5,339,916, the disclosures of which are hereby incorporated herein as of reference.

Figure 2:
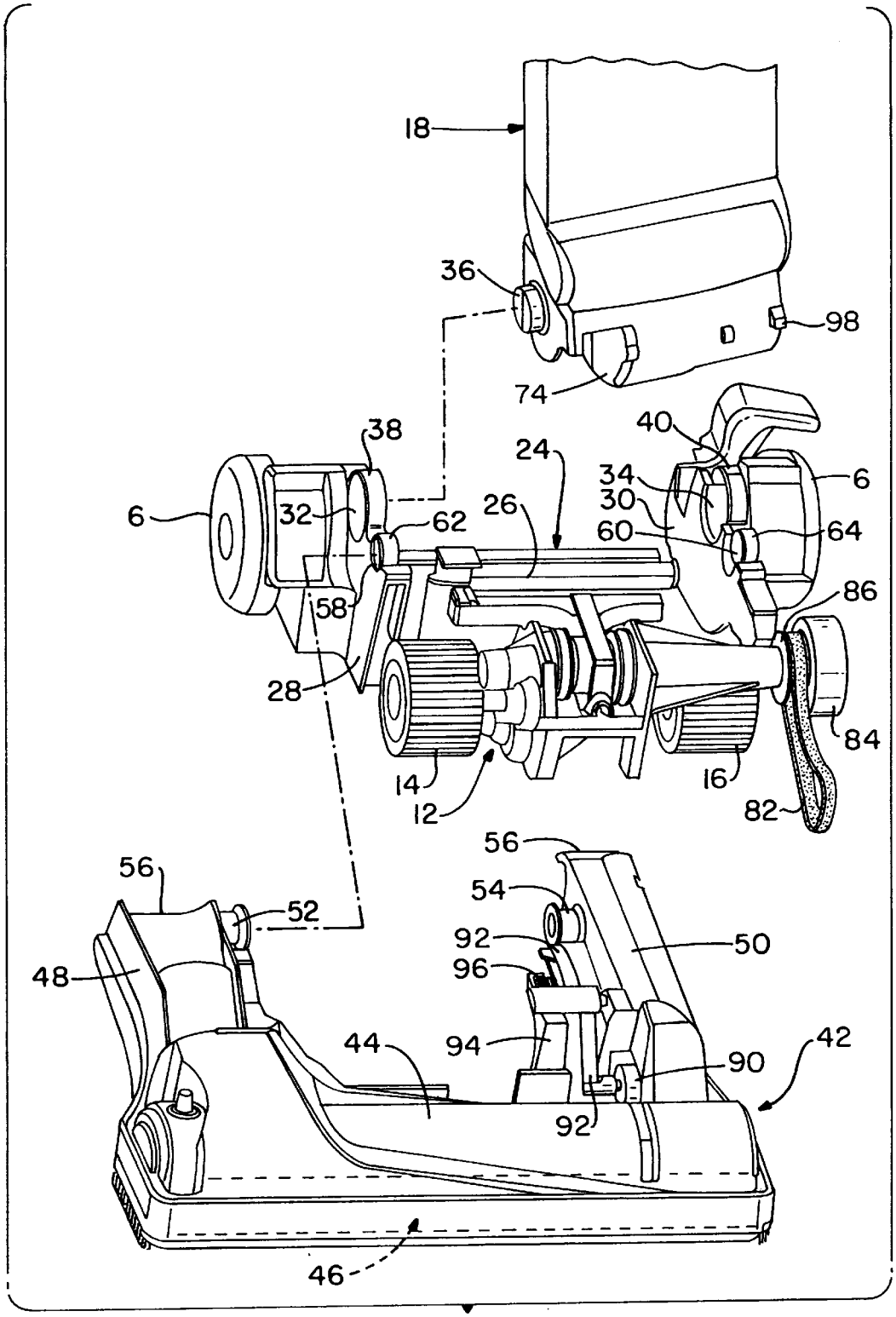
FIG. 2 is a partially exploded view of a self-propelled upright vacuum cleaner according to the present invention with the hood removed.
Figure 3:
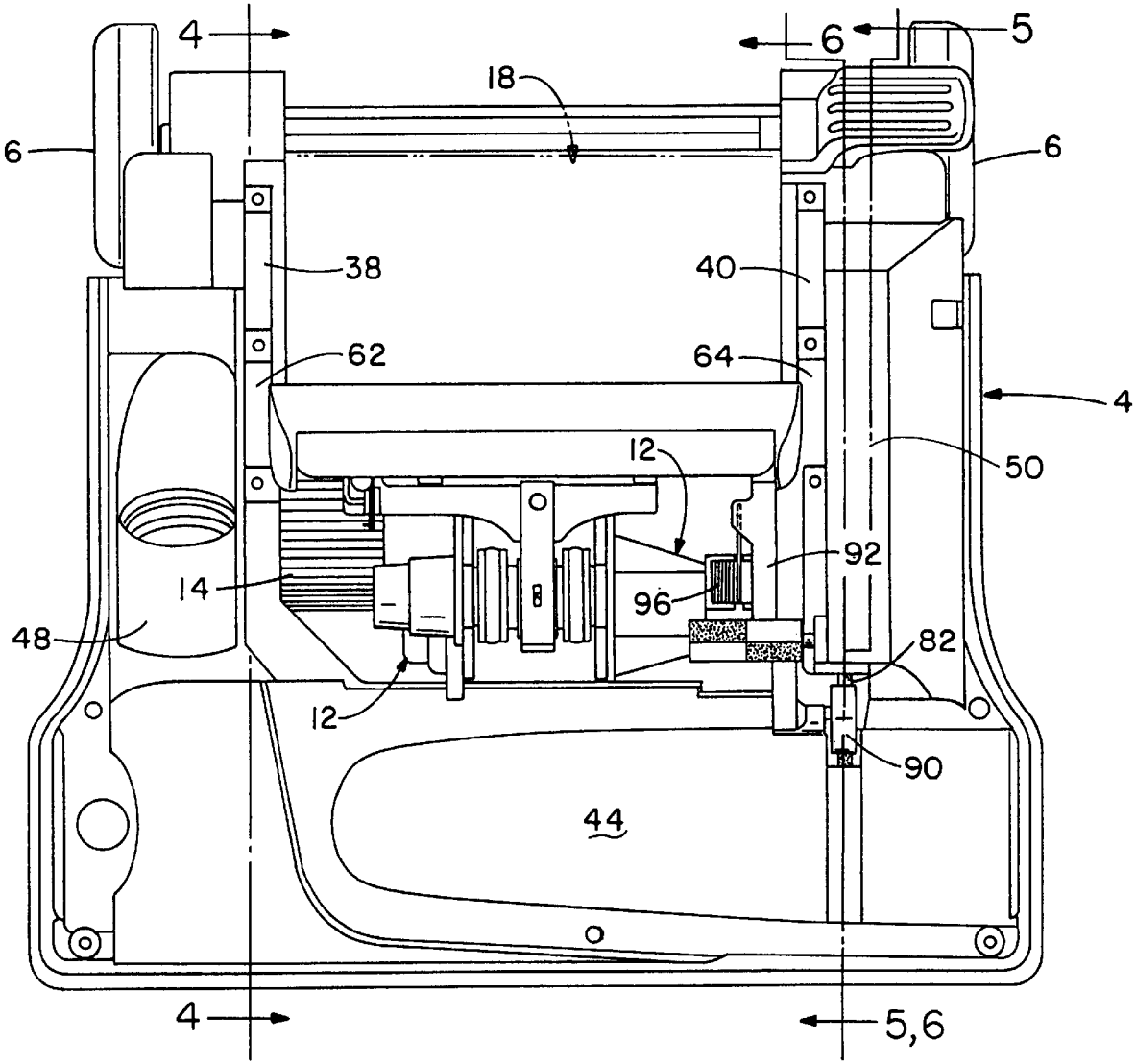
FIG. 3 is a top plan view of the lower portion of a vacuum cleaner according to the present invention with the hood removed.

Referring now to FIG. 2, the transmission 12 is mounted to a forward edge of a main frame or carriage 24 and the drive wheels 14 and 16 are mounted to the transmission's output shaft (not visible in FIG. 2). The carriage includes a generally horizontal base plate 26 and generally vertical sidewalls 28 and 30 extending up from side edges of the base plate. Semi-circular recesses 32 and 34 in the sidewalls of the carriage rotatably receive trunnions 36 (only one of which is visible in FIG. 2) extending out from opposite sides of the lower end of the handle portion 18 for pivotally mounting the handle portion to the carriage 24. Trunnions 36 are held in place on the carriage by metal straps 38 and 40 that are affixed to the carriage by screws (not shown). The carriage 24 thus freely pivots relative to the handle portion 18 about a carriage pivot axis C (see FIG. 4) defined by the trunnions 36. The drive wheels 14 and 16 are located toward the front of the carriage, the support wheels 6 are located to the rear of the carriage, and the carriage pivot axis is located horizontally between the drive wheels and the support wheels, such that the support wheels and the drive wheels cooperate to support the weight of the cleaner on a floor surface.

A nozzle body, generally indicated as 42, defines a transversely extending agitator chamber 44 having a downward opening nozzle or suction opening 46, shown in ghost in FIG. 2. A conventional rotary agitator (not shown in FIG. 2) is rotatably mounted in the agitator chamber in a conventional manner with its bristles extending out the nozzle opening for agitating a carpet. The agitator housing further includes side members 48 and 50 that extend generally rearward from the agitator chamber 44. Pivot posts 52 and 54 extend inward from a location near the rear ends 56 of the side members 48 and 50. The pivot posts are rotationally received in semi-circular recesses 58 and 60 in the sidewalls 28 and 30 of the carriage 24 for pivotally mounting the nozzle body 42 to the carriage for pivotal motion about nozzle pivot axis N (see FIG. 4). The pivot posts 52 and 54 are held in place on the carriage by metal straps 62 and 64 that are affixed to the carriage by screws (not shown).

Figure 4:
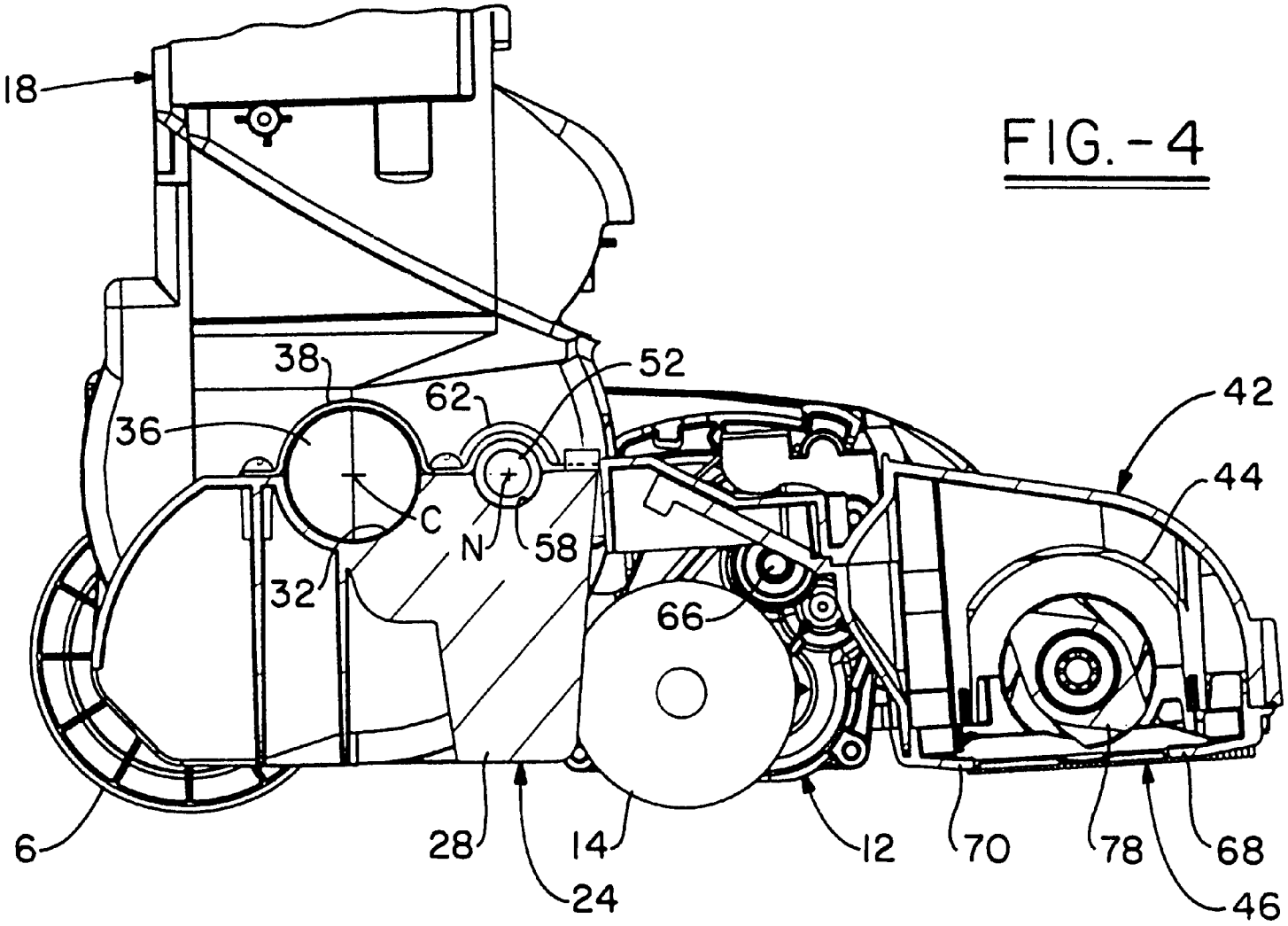
FIG. 4 is a cross-sectional view taken along line IV—IV in FIG. 3.

As best seen in FIG. 4, the handle portion 18 and the agitator body 42 are independently pivotally mounted to the carriage 24 at the carriage pivot axis C and the nozzle pivot axis N, respectively. The drive wheels 14 and 16 (only one of which is visible in FIG. 4) are spaced forward of the carriage pivot axis C, such that the drive wheels may "float" on a floor surface by pivoting up and down about the carriage pivot axis C. Likewise, the floor nozzle or agitator chamber 44 is spaced forward of nozzle pivot axis N, whereby the floor nozzle 46 may "float" on a floor surface by pivoting up and down about the nozzle pivot axis N. With this construction, the drive wheels and the floor nozzle "float" on the floor surface independently of each other, so that each maintains independent and substantially continuous contact with a floor surface to ensure substantially continuous, uninterrupted drive and cleaning.

The semi-circular recesses 58 and 60 defining the nozzle pivot axis N are located forward of the semi-circular recesses 32 and 34 defining the carriage pivot axis C, such that the nozzle pivot axis N is parallel to and offset from the carriage pivot axis C. Locating the nozzle pivot axis forward of the carriage pivot axis enables the portions of the handle portion 18, the nozzle body 42 and the carriage 24 that must be made relatively thick to withstand the stresses applied to these components during operation of the cleaner to be staggered, such that the relatively thick portions of these three components do not all overlap at the same location. Staggering the load bearing, relatively thick portions of the handle portion, the carriage, and the nozzle body makes it possible to manufacture these three components entirely out of modern plastic materials, without causing the overall width of the cleaner to be undesirably wide.

The nozzle pivot axis N is preferably spaced to the rear of the transmission input shaft 66. If the nozzle pivot axis were located coincident with the transmission input shaft, then the distance between the agitator chamber 44 and the nozzle pivot axis would be relatively short, resulting in a relatively short pivot arm. With such a relatively short pivot arm, when the nozzle body 42 moves up and down relative the carriage 24 as the cleaner moves over a floor and as the height setting of the floor nozzle is varied by the operator, the nozzle body would tilt relative the floor surface, such that a front nozzle lip 68 would be undesirably higher than a rear nozzle lip 70. The nozzle body would then be resting on the rear nozzle lip 70 and the front nozzle lip 68 would be raised off the floor creating a gap between the front lip and the floor. This gap would partially destroy the suction created in the agitator chamber and decrease the cleaning performance of the cleaner. In order to minimize the tilting of the nozzle body as the cleaner moves over the floor, the nozzle pivot axis N is preferably located as far to the rear of the cleaner as possible, so that the pivot arm between the nozzle pivot axis N and the agitator housing 44 is as long as possible. However, as previously mentioned, the nozzle pivot axis N is also preferably forward of the carriage pivot axis C.

Figure 5:
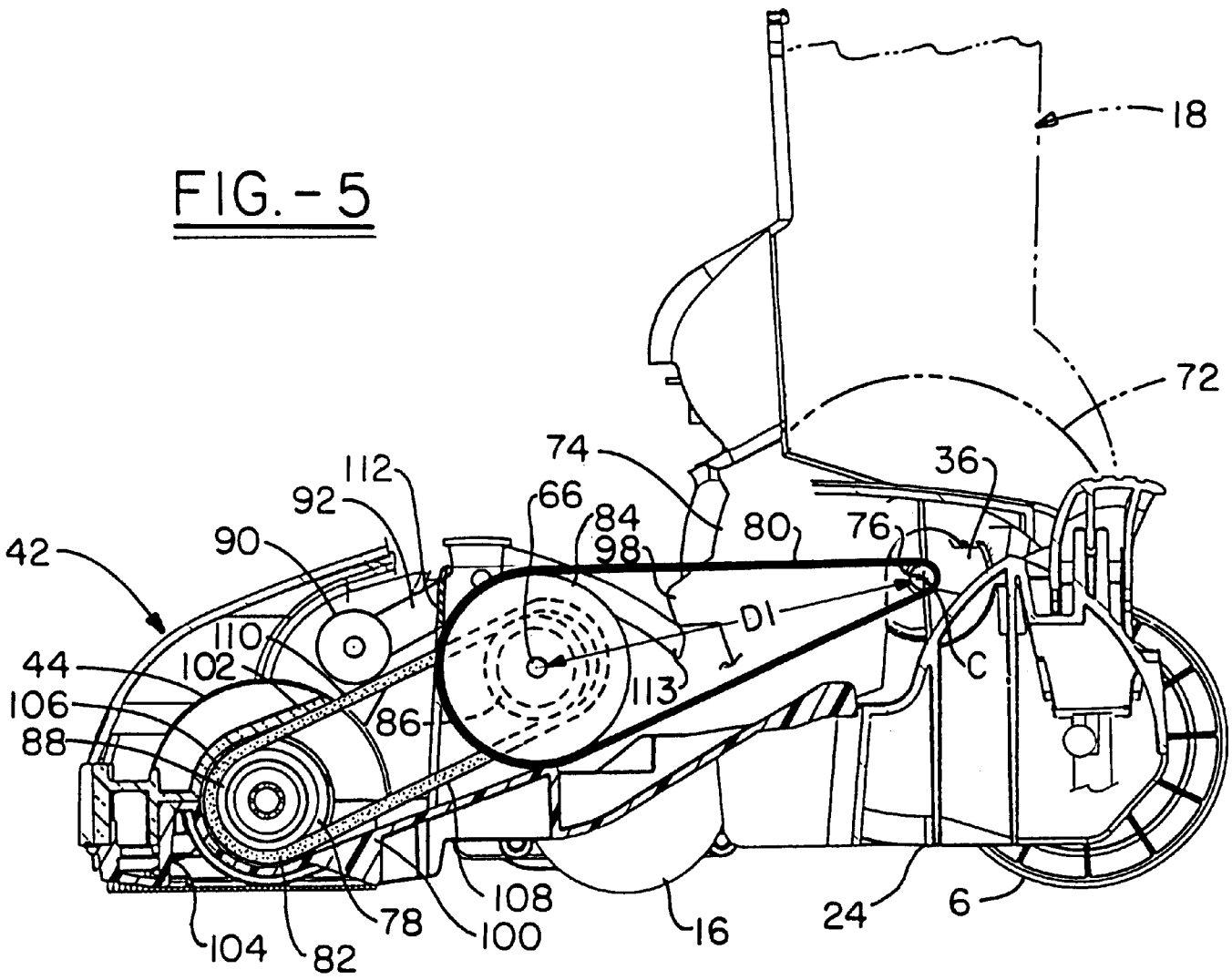
FIG. 5 is a partially broken away cross-sectional view taken along line V—V in FIG. 3.

Referring now to FIG. 5, an electric motor 72 (shown in ghost in FIG. 5) for powering the cleaner is located in a motor housing 74 defined by the lower end of the handle portion 18. The motor is preferably arranged such that the rotor shaft 76 extends horizontally and out both ends of the motor housing. A conventional fan (not shown) is affixed to one end of the rotor shaft (not shown) for generating suction. The other end of the rotor shaft 76 is utilized to drive the transmission 12 and the agitator 78 via a drive belt 80 and an agitator belt 82. The drive belt 80 extends from the rotor shaft 76 to a first pulley 84 fixed to the transmission's input shaft 66. The agitator belt 82 extends from a second pulley 86 (shown in ghost in FIG. 5) fixed to the transmission's input shaft to a third pulley 88 integrally formed on the agitator. The second pulley has a diameter that is smaller than the diameter of the first pulley in order to provide a speed reduction between the rotor shaft and the agitator. The second and third pulleys each preferably have a diameter of 1.5 inches and the third pulley preferably has a diameter of 2.36 inches.

The trunnions 36 on the handle portion 18 are concentric with the rotor shaft 76, such that the carriage pivot axis C is coincident with the longitudinal axis of the rotor shaft. With this construction the distance D1 between rotor shaft and the transmission's input shaft remains constant as the carriage pivots about the carriage pivot axis. The drive belt 80 is a conventional stretch belt having a flat or rectangular cross-section. The drive belt is stretched between the rotor shaft 76 and the first pulley 84, such that the natural elasticity of the drive belt maintains the drive belt under tension for transmitting power from the motor 72 to the transmission 12.

Figure 6:
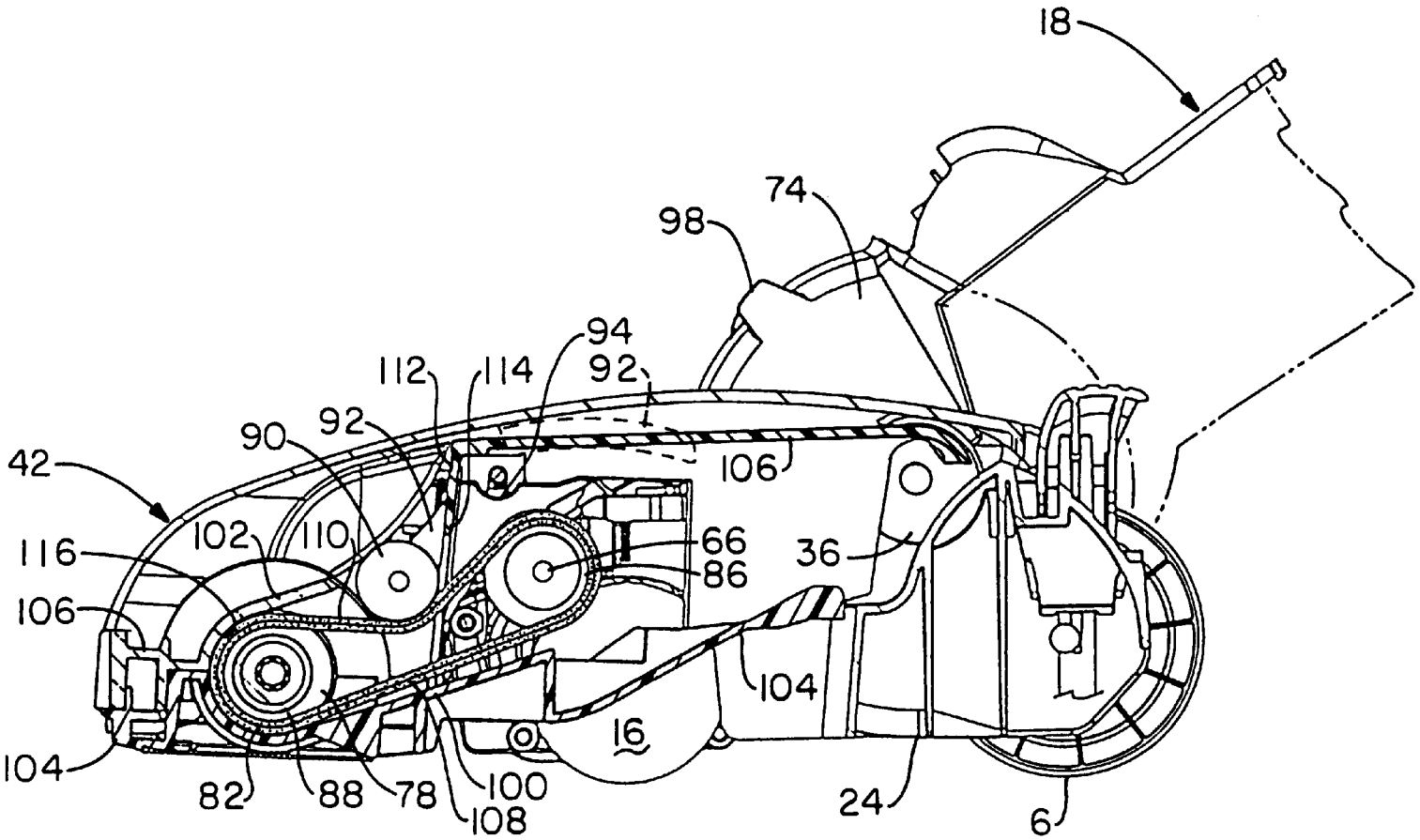
FIG. 6 is a cross-sectional view taken along line VI—VI in FIG. 3, but with the bag housing in the inclined operating position.

The agitator 78 pivots with the nozzle body 42 about the nozzle pivot axis N (not shown in FIG. 5), which is offset from the second pulley 86. Therefore the distance between the second pulley and the agitator varies as the nozzle body pivots about the nozzle pivot axis. The agitator belt 82 has a length that is greater than the distance between the second pulley and the agitator, such that there is slack in the agitator belt as illustrated in FIG. 5. In order to engage the agitator, an idler pulley 90 is mounted on the end of an idler arm 92 pivotally mounted adjacent to the agitator belt in a cradle 94 integrally molded into the agitator body 42 (as illustrated in FIG. 2). A spiral torsion spring 96 (also illustrated FIG. 2) is mounted to the top of the cradle under tension between the cradle and the idler arm. The torsion spring biases the idler arm 92 in a first direction about its pivot axis and presses the idler pulley 90 against the agitator belt 82 as illustrated in FIG. 6, thereby placing the agitator belt under tension and transferring power from the second pulley 86 to the agitator 78. The idler pulley maintains the agitator belt under substantially constant tension as the nozzle body 42 moves relative to the carriage 24 causing the distance between the second and third pulleys to vary.

Figure 8:
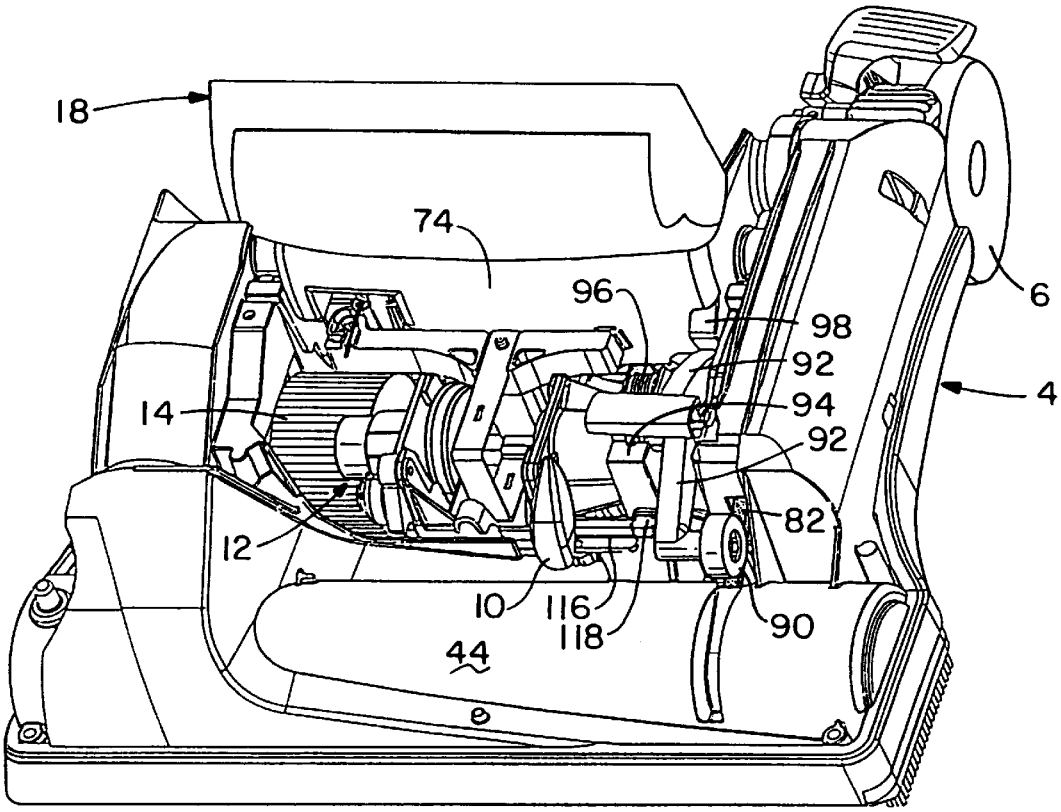
FIGS. 7 and 8 are partial perspective views of a self-propelled upright vacuum cleaner according to the present invention with the hood removed.

As illustrated in FIGS. 5 through 8, a protrusion or cam 98 is integrally molded into the motor housing 74. The protrusion 98 is located on the motor housing so that as the handle portion 18 is raised to the storage position, the protrusion contacts the idler arm 92 (as seen in FIG. 8) at a location spaced from the cradle 94 and pivots the idler arm in a second direction about its pivot axis, opposite the first direction, thereby moving the idler pulley 90 out of engagement with the agitator belt 82 as illustrated in FIGS. 5 and 8. The agitator belt is thus placed in a slack condition for disengaging the agitator from the second pulley and from the motor 72. A similar vacuum cleaner agitator belt drive release is disclosed in commonly owned U.S. Pat. No. 5,537,712, the disclosure of which is hereby incorporated herein as of reference.

Using an idler pulley to place a slack agitator belt under tension makes it possible to employ a V-belt formed of rubber reinforced with a relatively stiff, inelastic and durable cord material to transmit power from the second pulley to the agitator. The agitator belt has an initial circular or round configuration. Such a V-belt is durable enough to last for virtually the lifetime of the vacuum cleaner under normal operating conditions, thereby significantly reducing the need to replace the agitator belt under normal usage of the vacuum cleaner. The drive belt, on the other hand, is preferably a stretch belt having a flat or rectangular shape in cross-section that is formed of a relatively elastic material rubber material. The length of the drive belt is less than the distance D1 between the motor shaft and the first pulley, whereby the drive belt must be stretched to be mounted between the motor shaft and the first pulley. Thus, the drive belt is mounted under tension, such that the natural elasticity of the drive belt maintains the drive belt under tension.

The drive belt is less expensive and less durable than the agitator belt according to the present invention. The drive belt is designed to slip on the motor's output shaft when the agitator is accidentally stalled. Thus, the drive belt serves as an overload clutch that allows the motor to continue to rotate when the agitator stalls, thereby preventing the motor from stalling and burning out. As a result, the drive belt will likely require replacement during the lifetime of the vacuum cleaner. As discussed above, the agitator belt is designed to last considerably longer than the drive belt. Therefore, the second pulley 86 is located on the transmission input shaft inside of the first pulley 84, so that the agitator belt 82 does not have to be removed in order to replace the drive belt 80.

As best seen in FIGS. 5 and 6, lower and upper belt guides 100 and 102 are molded into a bottom plate 104 and into a top plate 106 of the agitator body 42. The lower belt guide 100 in the bottom plate is a vertical wall having an inclined top edge or surface that lies adjacent and generally parallel to a lower expanse 108 of the agitator belt 82. The upper belt guide 102 is formed by a similar wall having a lower edge or surface that lies adjacent and generally parallel to an upper expanse 110 of the agitator belt. The upper belt guide and a rib 112 having a lower end 114 adjacent to the upper expanse of the agitator belt are molded into the top plate. The bottom plate and the top plate cooperate to define a semi-cylindrical chamber having an inner peripheral surface 116 that closely surrounds the outer peripheral surface of the agitator belt 82 where the agitator belt is wrapped around the third pulley 88 formed on the agitator 78.

When the idler pulley 90 is moved away from the agitator belt 82, the natural stiffness and resiliency of the agitator belt causes the upper 110 and lower 108 expanses of the agitator belt to bow radially outwardly toward its initial circular shape until the agitator belt contacts the belt guides 100 and 102. Since further outward bowing of the upper and lower expanses of the agitator belt is prevented by the belt guides, the upper and lower expanses of the agitator belt are maintained in a substantially straight planar configuration. As the upper expanse of the agitator belt straightens, the ends of the agitator belt, i.e. where the agitator belt is wrapped around the second and the third pulleys, move away from each other. Since the end of the agitator belt wrapped around the third pulley on the agitator is prevented from moving away from the third pulley by the close proximity of the inner peripheral surface 116 of the annular chamber defined by the top plate and the bottom plate of the nozzle body, the end of the agitator belt wrapped around the second pulley 86 moves away from the second pulley as illustrated in FIG. 4. Thus, the agitator belt is lifted clear of the second pulley. It is critical that the agitator belt be lifted from the second pulley rather than the third pulley, because the second pulley is continuously driven by the motor.

If the agitator belt were to remain in contact with the second pulley when not under tension, the agitator belt would slip on the second pulley and the resulting friction would damage both the agitator belt and the second pulley.

In a preferred embodiment of the present invention, when the idler pulley 90 is located in the agitator-off position, as illustrated in FIG. 5, the outer peripheral surface of the idler pulley is substantially tangent to a plane extending from the lower surface of the upper belt guide 102 and the lower edge 114 of the rib 112. Thus, the idler pulley cooperates with the upper belt guide and rib in preventing the upper expanse 110 of the agitator belt from bowing outward when the idler pulley is moved to the agitator-off position.

When the bag housing 18 is in the storage position and an operator changes the nozzle height via the nozzle height adjustment knob 8, the nozzle body 42 moves relative the carriage 24. In order to prevent the idler pulley from moving relative to the agitator belt as the nozzle body moves relative the carriage, an inner end 113 of the idler arm and the end of the protrusion 98 on the motor housing are curved where they contact each other, such that position of the idler pulley 90 relative to the agitator belt remains unchanged as the nozzle body 42 moves relative to the carriage. The necessary curvature of the end of the idler arm and of the end of the protrusion is determined through experimentation.

Figure 7:
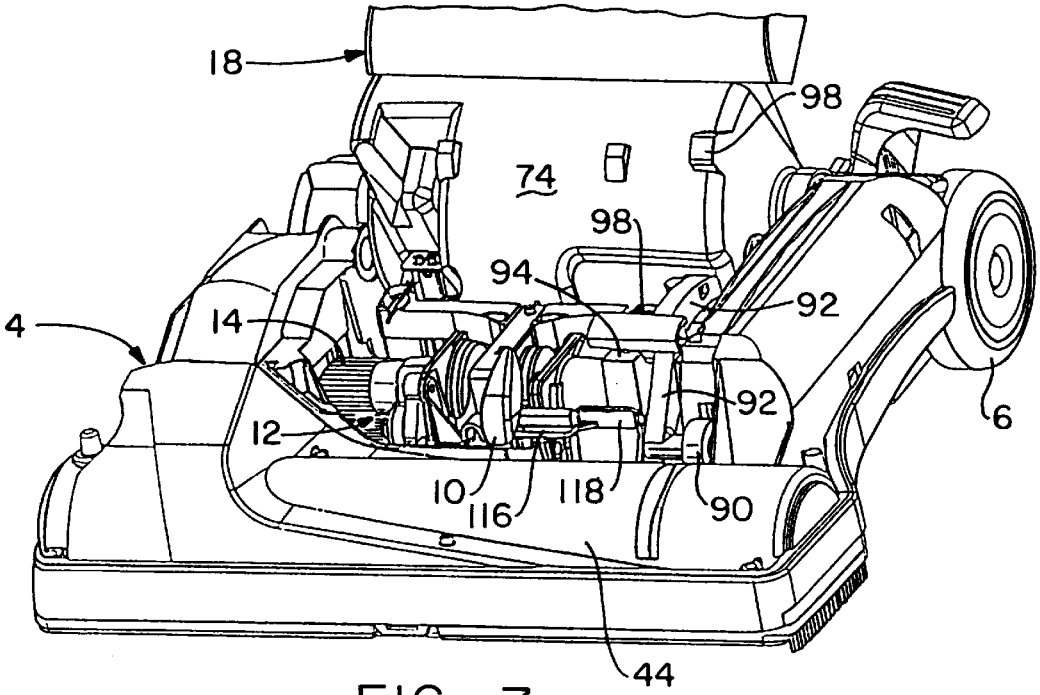

Referring now to FIGS. 7 and 8, the agitator shut-off knob 10 is mounted to the hood (not shown in FIGS. 7 and 8 ) on a slide 116 for reciprocal movement between an agitator-on position illustrated in FIG. 7 to an agitator-off position illustrated in FIG. 8. A finger 118 extends out from an end of the slide adjacent to the agitator belt and extends toward the agitator belt. When cleaning carpeted floors, the agitator shut-off knob 10 is located in the agitator-on position (illustrated 7), so that the agitator is driven for agitating the carpet in a conventional manner. When it is desired to clean bare floors, the bag housing 18 is first pivoted into the latched storage position in which the idler arm 92 is disengaged from the agitator belt 82 by the protrusion 98 and the agitator is turned off, as illustrated in FIG. 8. The operator then slides the agitator shut-off knob to the right, as viewed in FIGS. 7 and 8 into the agitator-off position illustrated in FIG. 8. When the agitator shut-off knob is in the agitator-off position, the finger 118 extends under the idler arm 92. When the operator subsequently inclines the bag housing into the operating position for cleaning the floor, the finger retains the idler arm in the disengaged position, such that the agitator remains disengaged.

It will be appreciated that a manual agitator shut-off knob with a finger according to the present invention could be used in a non-propelled upright vacuum having an automatically actuated belt tensioning idler pulley, as disclosed in previously mentioned U.S. Pat. No. 5,537,712, in order to provide such a cleaner with an agitator-off bare floor cleaning mode of operation.

It will also be appreciated that any suitable control link may be substituted for the disclosed the Bowden control cable without departing from the scope of the present invention. For example, a flexible strap, a rigid link or a system of rigid links may be substituted for the control cable. cable. Similarly, a drive belt has been disclosed for drivingly connecting the motor to the transmission. One of skill in the art will also recognize that the transmission may alternatively be connected to the motor by any suitable drive train, such as a gear train for example.

The present invention has been described above using a preferred embodiment by way of example only. Obvious modifications within the scope of the present invention will become apparent to one of ordinary skill upon reading the above description and viewing the appended drawings. The present invention described above and as claimed in the appended claims is intended to include all such obvious modifications within the scope of the present invention.

Wherefore we claim:

1. A vacuum cleaner comprising:

a) a floor engaging portion;

b) a handle portion pivotally mounted to said floor engaging portion for pivotal motion relative said floor engaging portion between a generally upright storage position and an inclined pivotal operating position;

c) an agitator rotatably mounted to said floor engaging portion for agitating a floor surface being cleaned;

d) a motor having an output shaft and an agitator belt extending between said output shaft and said agitator for selectively drivingly connecting said motor to said agitator;

e) a tensioning arm pivotally mounted to said floor engaging portion for pivotal motion between an agitator-on position in which said tensioning arm engages said agitator belt, thereby placing said agitator belt under tension whereby said agitator belt drives said agitator, and an agitator-off position in which said tensioning arm does not engage said agitator belt, thereby placing said agitator belt in a slack condition whereby said agitator belt does not drive said agitator;

f) a spring mounted between said floor engaging portion and said tensioning arm for biasing said tensioning arm into said agitator-on position;

g) said handle portion including an actuating portion that engages said tensioning arm when said handle portion is pivoted from said operating position into said storage position and thereby moves said tensioning arm into said agitator-off position, and disengages said tensioning arm when said handle portion is pivoted from said storage portion into said operating position whereby said spring moves said tensioning arm into said agitator-on position;

h) an agitator shut-off member mounted to said floor engaging portion, said agitator shut-off member being selectively movable between:

1) an on position in which said agitator shut-off member does not engage said tensioning arm, whereby said spring biases said tensioning arm into said agitator-on position; and 2) an off position in which said agitator shut-off member engages said tensioning arm when said tensioning arm is in said agitator-off position and thereby maintains said tensioning arm in said agitator-off position.

2. A vacuum cleaner according to claim 1, wherein said actuating portion comprises a protrusion on said handle portion.

3. A vacuum cleaner according to claim 2, wherein said agitator shut-off member comprises a slide reciprocally mounted to said floor engaging portion for movement between said on position and said off position.

4. A vacuum cleaner according to claim 3, wherein said agitator shut-off member includes a knob for manual reciprocation of said agitator shut-off member.

5. A vacuum cleaner according to claim 3, wherein said agitator shut-off member includes a finger extending therefrom that is located adjacent to said tensioning arm when said tensioning arm is in said agitator-off position and said agitator shut-off member is in said off position, whereby said finger blocks movement of said tensioning arm into said agitator-on position.

6. A vacuum cleaner according to claim 1, wherein said agitator shut-off member comprises a slide reciprocally mounted to said floor engaging portion for movement between said on position and said off position.

7. A vacuum cleaner according to claim 6, wherein said agitator shut-off member includes a knob for manual reciprocation of said agitator shut-off member.

8. A vacuum cleaner according to claim 1, further comprising an idler pulley rotatably mounted to said tensioning arm for selectively engaging said agitator belt and placing said agitator belt under tension.

9. A vacuum cleaner according to claim 1, wherein said floor engaging portion includes a first belt guide having a first guide surface extending generally parallel to and immediately adjacent to a first expanse of said agitator belt when said agitator belt is under tension, said first belt guide being located such that when said tensioning arm is pivoted to said agitator-off position, said first expanse of said agitator belt moves radially outward until said agitator belt contacts said first guide surface.

10. A vacuum cleaner according to claim 9, wherein said floor engaging portion includes a second belt guide having a second guide surface extending generally parallel to and immediately adjacent to a second expanse of said agitator belt when said agitator belt is under tension, said second belt guide being located such that when said tensioning arm is pivoted to said agitator-off position, said second expanse of said agitator belt moves radially outward until said agitator belt contacts said second guide surface.

11. A vacuum cleaner according to claim 10, wherein said floor engaging portion includes an agitator chamber having a generally semi-cylindrical inner surface, said agitator is mounted in said agitator chamber, and said agitator belt is looped around said agitator; and a portion of an inner peripheral surface of said agitator chamber located opposite said agitator belt is located immediately adjacent to an outer peripheral surface of said agitator belt, whereby said portion of said inner peripheral surface of said agitator chamber cooperates with said first and second belt guides to cause said agitator belt to be moved away from said motor output shaft when said agitator belt is not under tension.

12. A vacuum cleaner comprising:

a) a floor engaging portion;

b) a handle portion pivotally mounted to said floor engaging portion for pivotal motion relative said floor engaging portion between a generally upright storage position and an inclined pivotal operating position;

c) an agitator rotatably mounted to said floor engaging portion for agitating a floor surface being cleaned;

d) a motor having an output shaft;

e) a transmission having an input shaft and an output shaft selectively rotatable in forward and reverse directions, said transmission output shaft being drivingly connected to at least one drive wheel mounted for engagement with a floor surface for selectively propelling said floor engaging portion in forward and reverse directions;

f) a drive belt drivingly connecting said motor output shaft to said transmission input shaft;

g) an agitator belt extending between said transmission input shaft and said agitator for selectively drivingly connecting said motor to said agitator;

h) a tensioning member movable between an agitator-on position in which said tensioning member engages said agitator belt and places said agitator belt under tension whereby said agitator belt drives said agitator, and an agitator-off position in which said tensioning member does not engage said agitator belt such that said agitator belt is in a slack condition whereby said agitator belt does not drive said agitator;

i) said handle portion including an actuating portion that engages said tensioning member when said handle portion is pivoted from said operating position into said storage position and thereby moves said tensioning member into said agitator-off position;

j) an agitator shut-off member mounted to said floor engaging portion, said agitator shut-off member being selectively movable between:

1) an on position in which said agitator shutoff member does not engage said tensioning member, and 2) an off position in which said agitator shut-off member engages said tensioning member when said tensioning member is in said agitator-off position and thereby maintains said tensioning arm in said agitator-off position.

13. A vacuum cleaner according to claim 12, wherein said tensioning member is spring biased into said agitator-on position.

14. A vacuum cleaner according to claim 13, wherein said actuating portion comprises a protrusion on said handle portion that engages said tensioning member when said handle portion is pivoted to said storage position and thereby moves said tensioning member into said agitator-off position, and disengages said tensioning member when said handle portion is pivoted from said storage portion into said operating position whereby said spring moves said tensioning arm into said agitator-on position.

15. A vacuum cleaner according to claim 14, wherein said agitator shut-off member includes a knob, whereby an operator may actuate said agitator shut-off member by hand.

16. A vacuum cleaner according to claim 14, wherein said tensioning member is a tensioning arm pivotally mounted to said floor engaging portion for pivotal motion between said agitator-on and said agitator-off positions.

17. A vacuum cleaner according to claim 16, further comprising an idler pulley rotatably mounted to said tensioning arm for engaging said agitator belt and selectively placing said agitator belt under tension.

18. A vacuum cleaner according to claim 14, wherein said protrusion on said handle and said tensioning member are contoured, such that the location of said tensioning member relative to said agitator belt does not change as the pivotal orientation of said handle portion relative said floor engaging portion varies in said pivotal operating position.

19. A vacuum cleaner according to claim 12, wherein said agitator belt is mounted to said transmission input shaft inside of said drive belt.

20. A vacuum cleaner comprising:

a) a floor engaging portion;

b) a handle portion pivotally mounted to said floor engaging portion for pivotal motion relative said floor engaging portion between a generally upright storage position and an inclined pivotal operating position;

c) an agitator rotatably mounted to said floor engaging portion for agitating a floor surface being cleaned;

d) a motor;

e) an agitator belt extending between said motor and said agitator for selectively drivingly connecting said motor to said agitator;

f) a tensioning member movable between an agitator-on position in which said tensioning member engages said agitator belt, thereby placing said agitator belt under tension whereby said agitator belt drives said agitator, and an agitator-off position in which said tensioning member does not engage said agitator belt, thereby placing said agitator belt in a slack condition whereby said agitator belt does not drive said agitator;

g) said handle portion including an engaging portion that engages said tensioning member when said handle portion is pivoted from said operating position into said storage position and thereby moves said tensioning member into said agitator-off position;

h) an agitator shut-off member mounted to said floor engaging portion, said agitator shut-off member being selectively movable between:

1) an on position in which said agitator shut-off member does not engage said tensioning member; and 2) an off position in which said agitator shut-off member engages said tensioning member when said tensioning member is in said agitator-off position and thereby maintains said tensioning arm in said agitator-off position.

21. A vacuum cleaner according to claim 20, wherein said tensioning member is biased into said agitator-on position.

22. A vacuum cleaner according to claim 21, wherein said engaging portion comprises a cam surface on said handle portion that engages said tensioning member when said handle portion is pivoted to said storage position and moves said tensioning member into said agitator-off position, and disengages said tensioning member when said handle portion is pivoted from said storage portion into said operating position whereby said tensioning member is biased into said agitator-on position.

23. A vacuum cleaner according to claim 22, wherein when said agitator shut-off member includes a knob, whereby an operator may actuate said agitator shut-off member by hand.

* * * * *